US011735125B2

(12) United States Patent
Chen

(10) Patent No.: US 11,735,125 B2
(45) Date of Patent: Aug. 22, 2023

(54) IMAGE DISPLAY DEVICE AND CONTROL METHOD FOR MOTION BLUR REDUCTION THEREOF

(71) Applicant: Qisda Corporation, Taoyuan (TW)

(72) Inventor: Min-Jye Chen, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 17/749,262

(22) Filed: May 20, 2022

(65) Prior Publication Data

US 2023/0169929 A1 Jun. 1, 2023

(30) Foreign Application Priority Data

Dec. 1, 2021 (TW) ..... 110144912

(51) Int. Cl.
*G09G 3/34* (2006.01)
*G09G 3/32* (2016.01)

(52) U.S. Cl.
CPC ..... *G09G 3/3406* (2013.01); *G09G 3/32* (2013.01); *G09G 2310/0237* (2013.01); *G09G 2310/06* (2013.01); *G09G 2310/08* (2013.01); *G09G 2320/0257* (2013.01); *G09G 2320/062* (2013.01); *G09G 2320/064* (2013.01); *G09G 2370/022* (2013.01)

(58) Field of Classification Search
CPC ..... G09G 3/3406; G09G 2310/0237
See application file for complete search history.

(56) References Cited

U.S. PATENT DOCUMENTS 11,081,065 B2 * 8/2021 Mao ..... G09G 3/3406
2010/0073390 A1 * 3/2010 Myers ..... G09G 3/2092 345/581
2010/0265280 A1 * 10/2010 Yen ..... G09G 3/3406 345/691
2012/0162289 A1 * 6/2012 Oniki ..... G09G 3/342 345/102
2015/0145901 A1 * 5/2015 Lee ..... G09G 3/3614 345/96
2020/0152148 A1 * 5/2020 Chen ..... G09G 3/3648
2022/0246103 A1 * 8/2022 Chen ..... G09G 3/36

FOREIGN PATENT DOCUMENTS

TW 201039320 A1 11/2010
TW 202018691 A 5/2020

OTHER PUBLICATIONS

Office action of counterpart application by Taiwan IP Office dated Jun. 29, 2022.

* cited by examiner

*Primary Examiner* — Bryan Earles
*Assistant Examiner* — Bipin Gyawali

(57) ABSTRACT

The application discloses an image display device and a control method thereof. The control method for the image display device includes: receiving a first image signal from a host and displaying a frame, a first frame data of the first image signal having a first frequency; determining that the image display device enters a Motion Blur Reduction (MBR) mode and writing a double frequency of a vertical synchronous signal into a storage unit; and informing the host to read the storage unit and alternatively outputting a second frame data and a black-insertion frame data from the host, the second frame data having a second frequency higher than the first frequency.

20 Claims, 8 Drawing Sheets

IMAGE DISPLAY DEVICE AND CONTROL METHOD FOR MOTION BLUR REDUCTION THEREOF

IMAGE DISPLAY DEVICE AND CONTROL METHOD THEREOF

This application claims the benefit of Taiwan application Serial No. 110144912, filed Dec. 1, 2021, the subject matter of which is incorporated herein by reference.

BACKGROUND OF THE INVENTION

Field of the Invention

The invention relates in general to an image display device and a control method thereof.

Description of the Related Art

In one of black frame insertion technologies, a full black frame is cyclically inserted into two frames, so that the frames which originally have smearing will become clear. However, the implementation of the black frame insertion technology requires a high standard scaler, which alternately outputs normal frames and full black frames at double frequency. Thus, the cost increases.

In another black frame insertion technology, black frames are inserted into normal frames by controlling the ON/OFF state of backlight. Such technology requires the installation of extra corresponding control circuits, which also increases the cost.

Moving picture response time (MPRT) technology is for reducing frame blurs. For example, the backlight is temporarily turned off during the process of screen color conversion and then is turned on once color conversion is completed. With the MPRT technology, the persistence effect of each frame on the screen is reduced through the reduction in the display time of each frame on the screen, so that the phenomena of frame smearing and afterimages can be reduced.

Therefore, it has become a prominent task for the industries to support the MPRT technology and to remove red residues at low cost and high efficiency without changing the backlight control mechanism.

SUMMARY OF THE INVENTION

According to one embodiment of the present invention, a control method for an image display device is provided. The control method includes: receiving a first image signal from a host and displaying a frame, wherein a first frame data of the first image signal has a first frequency; determining that the image display device enters a motion blur reduction (MBR) mode and writing a double frequency of a vertical synchronous signal into a storage unit; and informing the host to read the storage unit, and alternatively output a second frame data and a black-insertion frame data from the host, wherein the second frame data has a second frequency higher than the first frequency.

According to another embodiment of the present invention, an image display device is provided. The image display device includes: a scaler, a backlight module and a storage unit. The backlight module is coupled to the scaler, and the storage unit coupled to the scaler The image display device receives a first image signal from a host and displaying a frame, wherein a first frame data of the first image signal has a first frequency. When the scaler determines that the image display device enters a motion blur reduction (MBR) mode, the scaler writes a double frequency of a vertical synchronous signal into a storage unit. The scaler informs the host to read the storage unit, and, the image display device receives a second frame data and a black-insertion frame data alternatively outputted from the host, wherein the second frame data has a second frequency higher than the first frequency.

According to an alternate embodiment of the present invention, a control method for an image display device is provided. The control method includes: determining by a zoom control chip that the image display device enters an MBR mode; informing a host by the zoom control chip to transmit a first image signal, wherein a first frame data of the first image signal has a first frequency; and alternatively outputting a second frame data and a black-insertion frame data by the zoom control chip, wherein the second frame data has a second frequency lower than the first frequency.

According to another alternate embodiment of the present invention, an image display device is provided. The image display device includes: a scaler, a backlight module, and a storage unit. The backlight module is coupled to the scaler. The storage unit is coupled to the scaler. The scaler determines that the image display device enters an MBR mode. The scaler informs a host to transmit a first image signal, wherein a first frame data of the first image signal has a first frequency. The scaler alternatively outputs a second frame data and a black-insertion frame data, wherein the second frame data has a second frequency lower than the first frequency.

The above and other aspects of the invention will become better understood with regard to the following detailed description of the preferred but non-limiting embodiment(s). The following description is made with reference to the accompanying drawings.

DETAILED DESCRIPTION OF THE INVENTION

Technical terms are used in the specification with reference to the prior art used in the technology field. For any terms described or defined in the specification, the descriptions and definitions in the specification shall prevail. Each embodiment of the present invention has one or more technical features.

Given that each embodiment is implementable, a person ordinarily skilled in the art can selectively implement or combine some or all of the technical features of any embodiment of the present invention.

Figure 1:
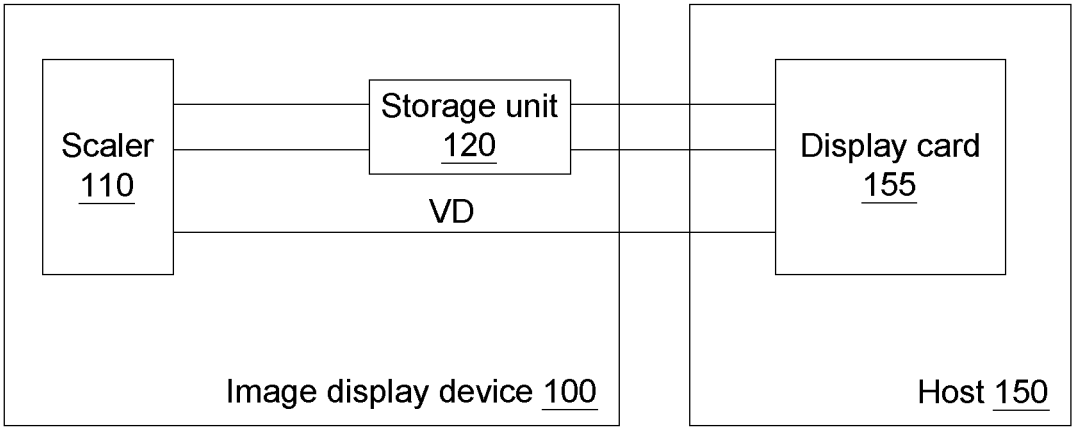
FIG. 1 is a functional block diagram of an image display device according to an embodiment of the present invention.

FIG. 1 is a functional block diagram of an image display device according to an embodiment of the present invention. As indicated in FIG. 1, the image display device 100 according to an embodiment of the present invention includes a scaler 110 and a storage unit 120. The storage unit 120 is coupled to the scaler 110 and stores parameters such as extended display identification data (EDID). The EDID includes but not limited to frequency of vertical synchronous signal, resolution of display, manufacturer names, serial numbers, and so on.

The host 150 is coupled to the image display device 100 and includes a display card 155. The host 150 can transmit image data VD to the image display device 100.

Figure 2:
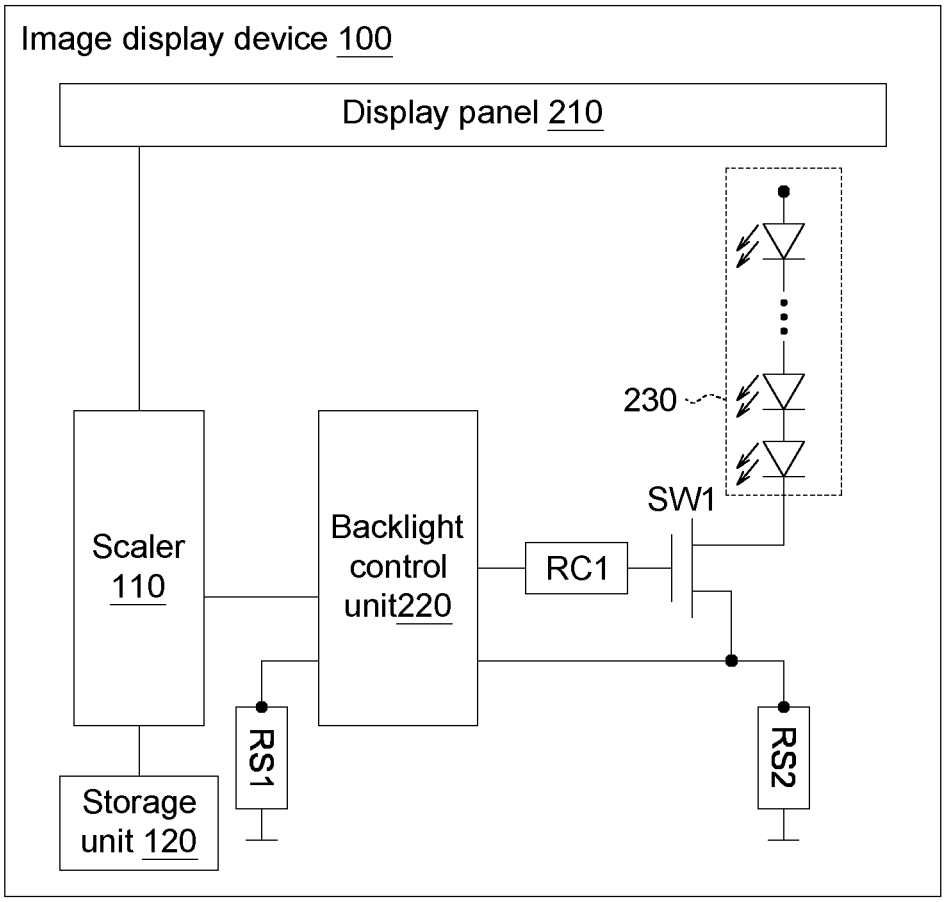
FIG. 2 is a functional block diagram of an image display device according to an embodiment of the present invention.

FIG. 2 is a functional block diagram of an image display device according to an embodiment of the present invention. As indicated in FIG. 2, the image display device 100 according to an embodiment of the present invention further includes a display panel 210, a backlight control unit 220, a backlight module 230, a switch SW1 and a plurality of resistors RC1, RS1 and RS2.

The display panel 210 and the backlight control unit 220 are coupled to the scaler 110. The display panel 210 is configured to display an image. The backlight control unit 220 is further coupled to a backlight module 230 to control the backlight module 230. The scaler 110 can transmit a pulse width modulation (PWM) signal to the backlight control unit 220 for the backlight control unit 220 to perform backlight PWM control on the backlight module 230.

The backlight module 230 includes a plurality of light emitting diodes (LED) connected in series.

The switch SW1 and the resistors RC1, RS1 and RS2 are coupled to the backlight control unit 220. The three terminals of the switch SW1 are coupled to the backlight module 230 and the backlight control unit 220. The resistor RC1 is coupled between the switch SW1 and the backlight control unit 220. The resistor RS1 is coupled between the backlight control unit 220 and the ground end. The resistor RS2 is coupled between the backlight control unit 220 and the ground end.

Figure 3:
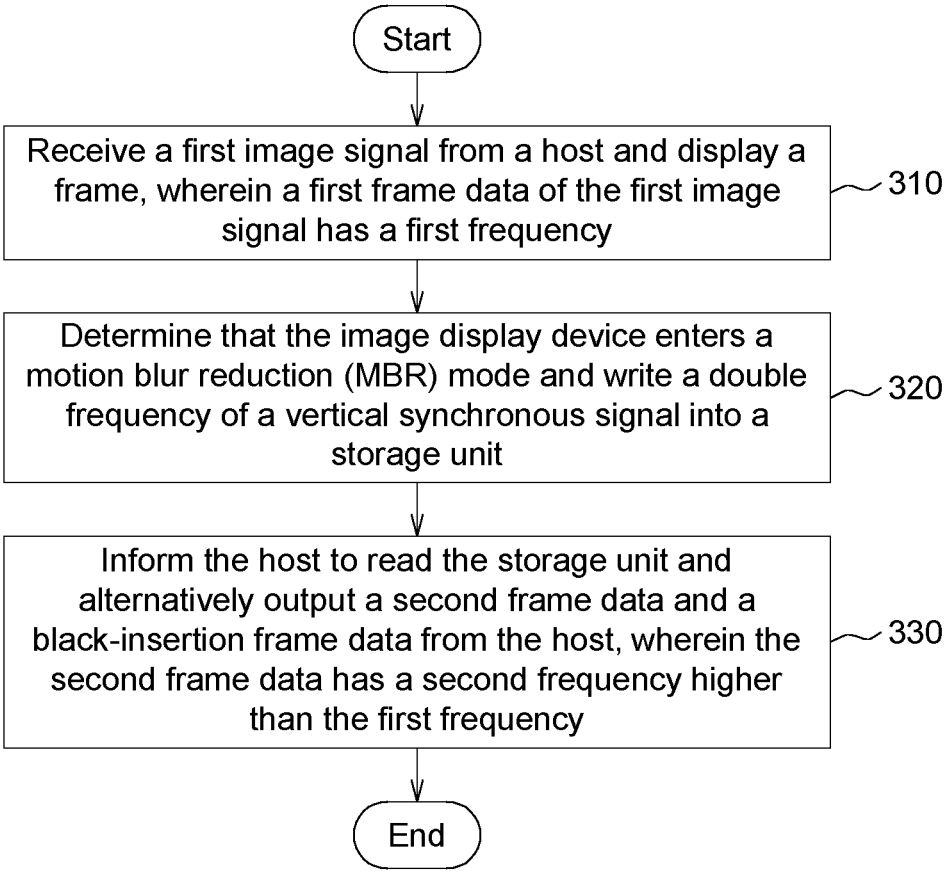
FIG. 3 is a control method for an image display device according to an embodiment of the present invention.

FIG. 3 is a control method for an image display device according to an embodiment of the present invention. The control method includes the following steps. In step 310, a first image signal is received from a host and a frame is displayed, wherein a first frame data of the first image signal has a first frequency. In step 320, it is determined that the image display device enters a motion blur reduction (MBR) mode, and a double frequency of a vertical synchronous signal is written into a storage unit. In step 330, the host is informed to read the storage unit and alternatively output a second frame data and a black-insertion frame data, wherein the second frame data has a second frequency higher than the first frequency.

Figure 4A:
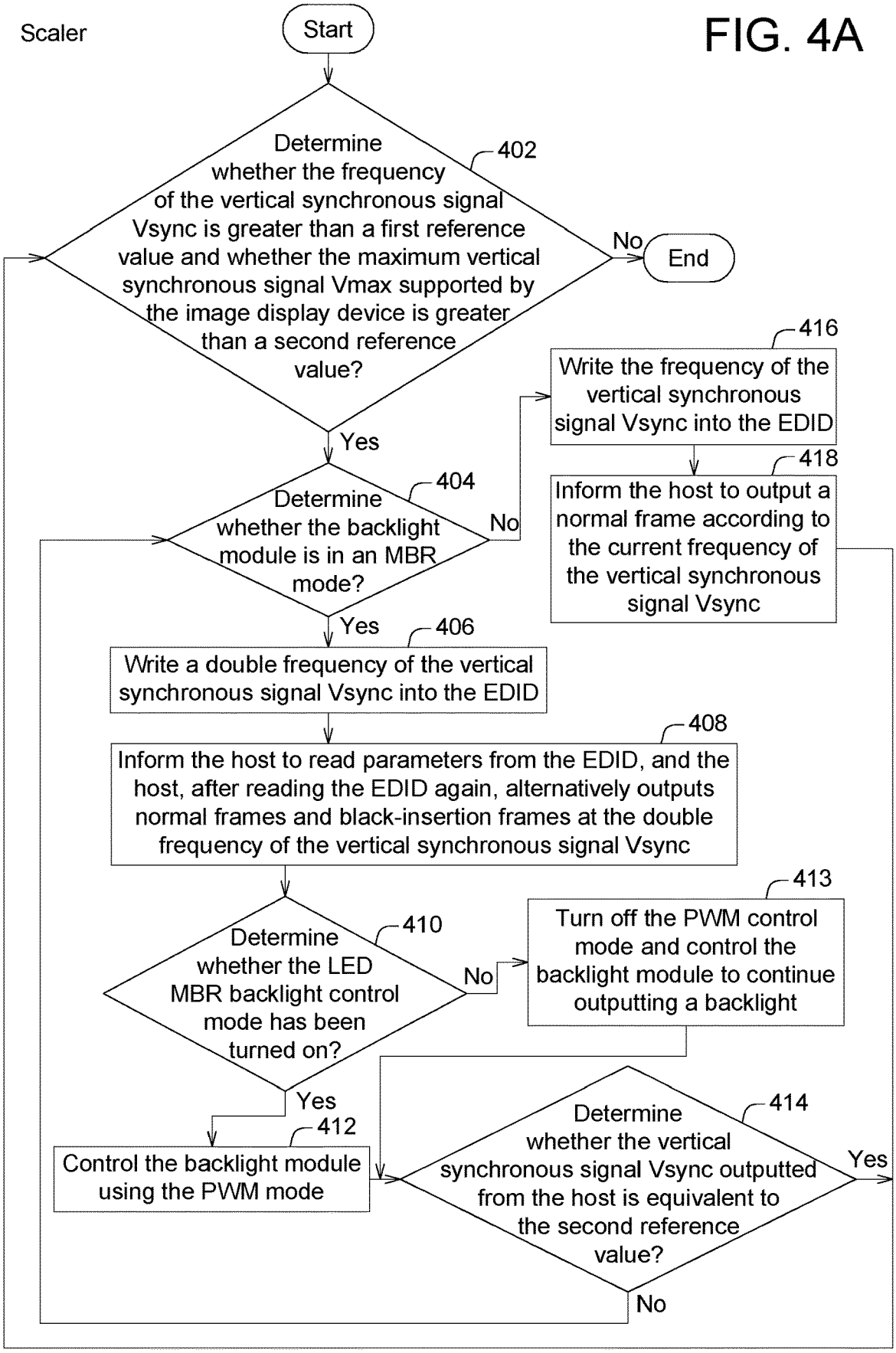
FIG. 4A and FIG. 4B are flowcharts of a control method for an image display device according to another embodiment of the present invention.
Figure 4B:
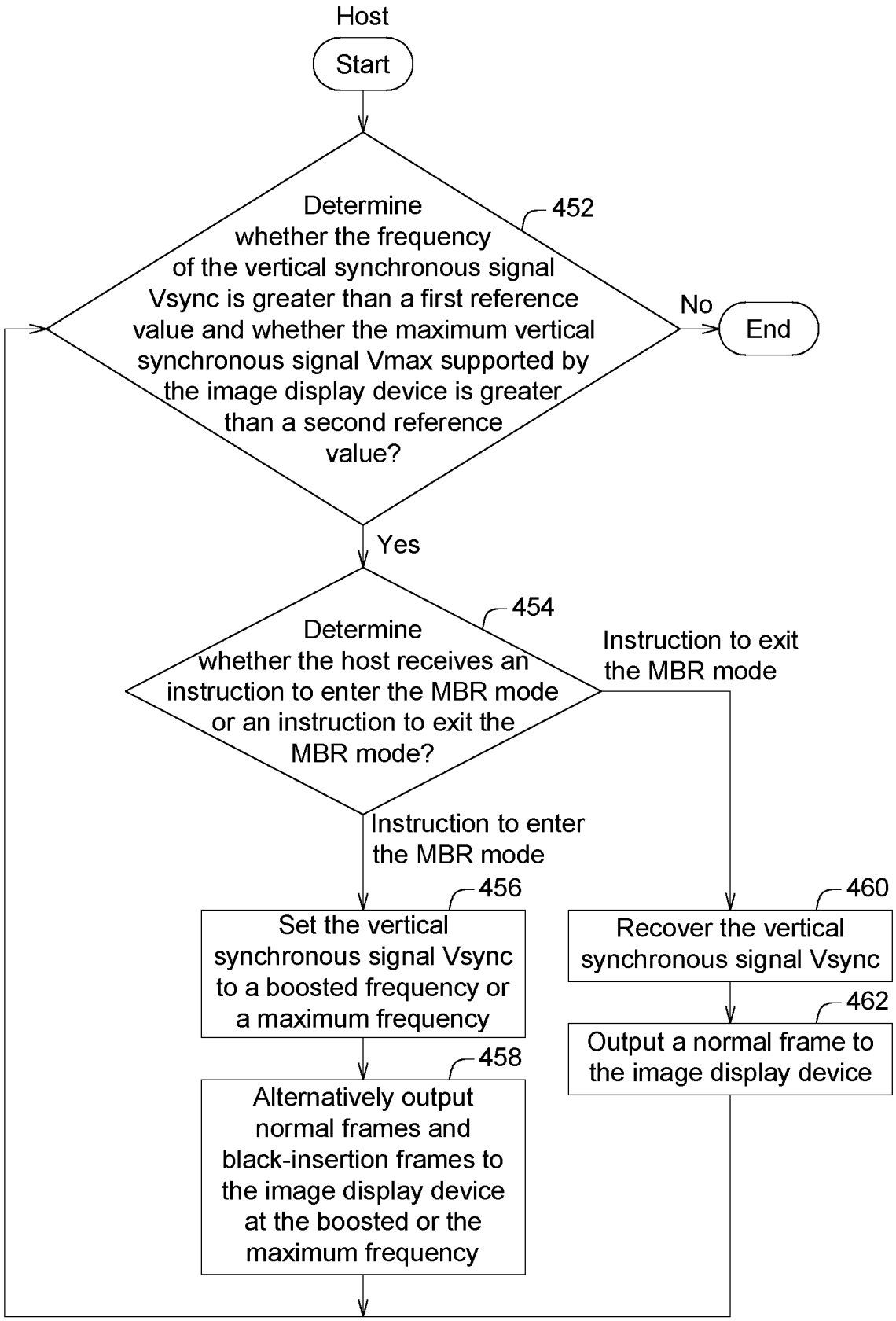

FIG. 4A and FIG. 4B are flowcharts of a control method for an image display device according to another embodiment of the present invention. FIG. 4A and FIG. 4B are respectively executed by the scaler 110 and the host 150. FIG. 4A and FIG. 4B are detailed flowcharts of FIG. 3. In each image frame cycle (Vsync), the scaler 110 and the host 150 enter a subroutine to wait for the processing of inputted signal and confirm the scope of motion blur reduction (MBR).

In step 402, whether the frequency of the vertical synchronous signal Vsync of the received image data VD is greater than a first reference value and whether the maximum vertical synchronous signal Vmax supported by the image display device 100 is greater than a second reference value are determined by the scaler 110. In an illustrative rather than a restrictive sense, the first reference value and the second reference value are exemplified by 120 Hz and 240 Hz respectively. If the determination result in step 402 is positive, then the method proceeds to step 404. If the determination result in step 402 is negative, then the method terminates. Step 402 can be regarded as detailed descriptions of step 310. That is, the statement that when the scaler 110 determines that the frequency of the vertical synchronous signal Vsync of the received image data VD is the first reference value is equivalent to the statement that the image display device 100 receives a first image signal from the host 150 and displays a frame, wherein a first frame data of the first image signal has a first frequency.

In step 404, whether the backlight module 230 is in a motion blur reduction (MBR) mode is determined by the scaler 110. If the determination result in step 404 is positive, then the method proceeds to step 406. If the determination result in step 404 is negative, then the method proceeds to step 416.

In step 406, a double frequency of the vertical synchronous signal Vsync is written into the EDID by the scaler 110. Steps 404 and 406 can be regarded as detailed descriptions of step 320.

In step 408, the host 150 is informed by the scaler 110 to read parameters from the EDID, and the host 150, after reading the EDID again, alternatively outputs normal frames and black-insertion frames at the double frequency of the vertical synchronous signal Vsync. In an embodiment of the present invention, the black-insertion frame can be a black image, a gray image or an image whose brightness is proportionally decreased. Step 408 can be regarded as detailed descriptions of step 330. That is, the statement that the host 150, after reading the EDID stored in the storage unit 120, alternatively outputs normal frames and black-insertion frames at the double frequency of the vertical synchronous signal Vsync is equivalent to the statement that the image display device 100 informs the host 150 to read the storage unit 120, and, the host 150 alternatively outputs a second frame data and a black-insertion frame data, wherein the second frame data has a second frequency higher than the first frequency.

In step 410, whether the LED MBR backlight control mode has been turned on is determined by the scaler 110. If the determination result in step 410 is positive, then the method proceeds to step 412. If the determination result in step 410 is negative, then the method proceeds to step 413.

In step 412, the backlight module 230 is controlled by the scaler 110 using the PWM mode. In an embodiment of the present invention, three methods for controlling the PWM mode of the backlight module 230 are exemplified below, but the present invention is not limited thereto. (1) The scaler 110 detects the current frame state, and controls the backlight module 230 using the PWM mode in synchronization with the normal frame. (2) The scaler 110 controls the backlight module 230 using the PWM mode in synchronization with the vertical synchronous signal Vsync. (3) The scaler 110 detects the current frame state and independently controls the backlight module 230 using the PWM mode in synchronization with the normal frame.

In step 413, if the LED MBR backlight control mode is turned off (that is, the LED MBR backlight control mode is disabled), then the PWM control mode is turned off, and the backlight module 230 is changed to continue outputting a backlight.

In step 414, whether the vertical synchronous signal Vsync outputted from the host 150 is equivalent to the second reference value is determined by the scaler 110. If the determination result in step 414 is positive, then the method proceeds to step 402; If the determination result in step 414 is negative, then the method proceeds to step 404.

In step 416, if the backlight module is not in the MBR mode, the frequency of the vertical synchronous signal Vsync (120 Hz) is written into the EDID by the scaler 110.

In step 418, the host 150 is informed by the scaler 110 to output a normal frame according to the current frequency of the vertical synchronous signal Vsync.

Details of the control method for the host 150 are disclosed below.

In step 452, whether the frequency of the vertical synchronous signal Vsync of the received image data VD is greater than a first reference value and whether the maximum vertical synchronous signal Vmax supported by the image display device 100 is greater than a second reference value are determined by the host 150. If the determination result in step 452 is positive, then the method proceeds to step 454. If the determination result in step 452 is negative, the method terminates.

In step 454, whether the host 150 receives an instruction to enter the MBR mode or an instruction to exit the MBR mode transmitted from the scaler 110 is determined.

When the host 150 receives the instruction to enter the MBR mode from the scaler 110, in step 456, the vertical synchronous signal Vsync is set to a boosted frequency or a maximum frequency by the host 150. In step 458, normal frames and black-insertion frames are alternatively outputted to the image display device 100 by the host 150 at the boosted or the maximum frequency.

When the host 150 receives the instruction to exit the MBR mode from the scaler 110, in step 460, the host 150 recovers the vertical synchronous signal Vsync, and in step 462, the host 150 outputs a normal frame to the image display device 100.

Figure 5:
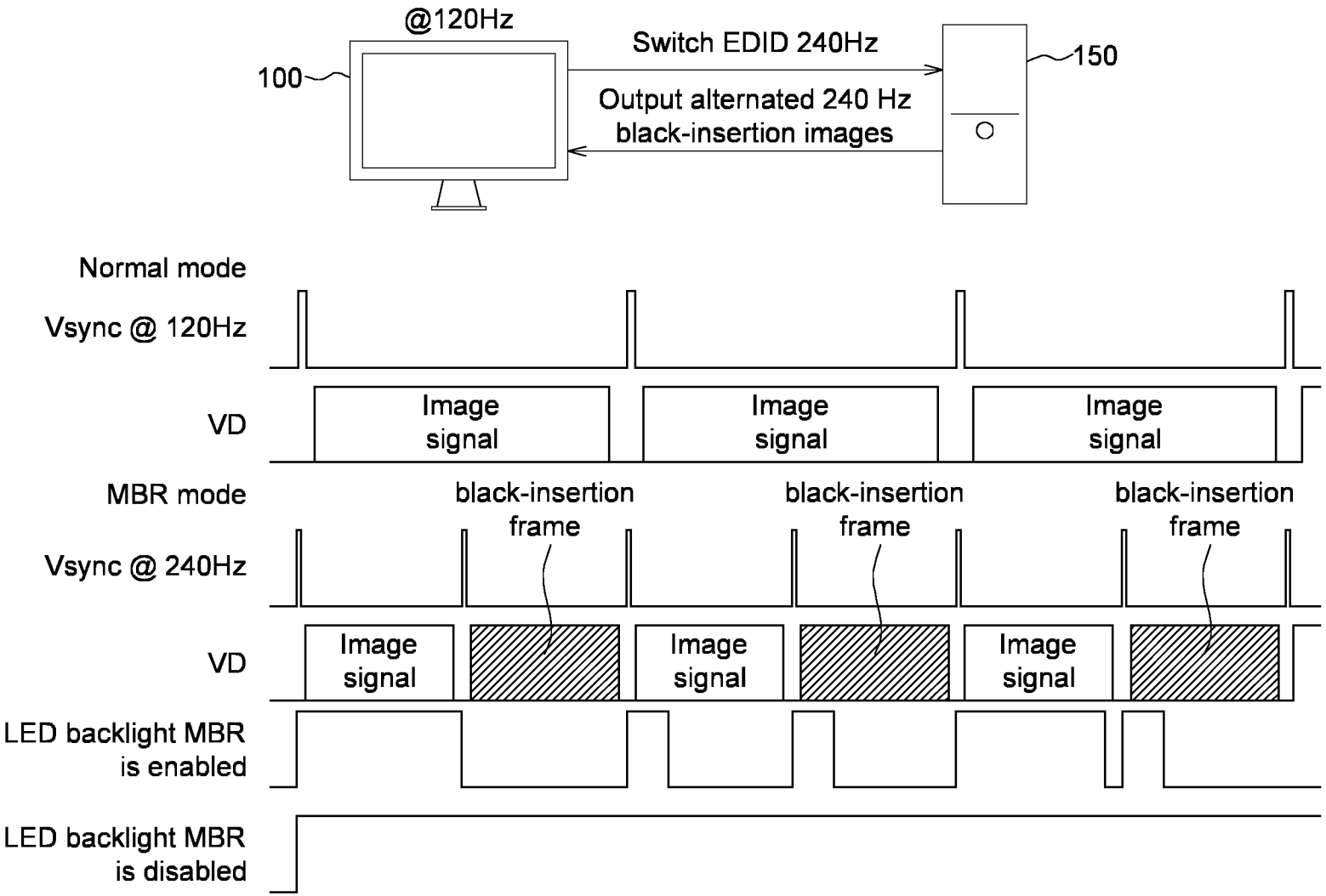
FIG. 5 is a signal waveform diagram according to an embodiment of the present invention.

FIG. 5 is a signal waveform diagram according to an embodiment of the present invention. As indicated in FIG. 5, in a normal mode, the vertical synchronous signal Vsync can be exemplified by 120 Hz but is not limited thereto, then the image data outputted from the host 150 is a normal frame. In a normal mode, the normal frame has a frequency (that is, a first frequency of a first frame data of the first image signal as illustrated in step 310), which can be exemplified by 120 Hz but is not limited thereto.

In the MBR mode, assuming but not limited to, the vertical synchronous signal Vsync is 240 Hz, the host 150 alternatively outputs normal frames and black-insertion frames. In the MBR mode, the frequency of a normal frame is higher than the frequency of a normal frame in a normal mode (that is, a second frequency of the second frame data higher than the first frequency as illustrated in step 330). The second frequency can be exemplified by 240 Hz but is not limited thereto.

As indicated in FIG. 5, the LED backlight MBR enabling signal can be synchronized with the normal frame or the vertical signal Vsync. Besides, in the LED backlight MBR mode, the LED backlight MBR disabling signal is pulled high.

In an embodiment of the present invention, as indicated in FIG. 5, through the application of the embodiments of the present invention, an ordinary 240 Hz display not equipped with hardware MBR enabling function still can obtain MBR effect. This is one of the advantages and effects of the embodiments of the present invention.

In an embodiment of the present invention, when the user switches the MPRT function, the frequency of the vertical synchronous signal is doubled or boosted and then is written into the EDID, and the host is informed to alternatively output normal frames and black-insertion frames. Hence, in an embodiment of the present invention, LCD black-insertion can directly reduce motion blur and eliminate fluorescent red residuals without changing the backlight mechanism.

In each image frame cycle (Vsync), the scaler 110 and the host 150 enter a subroutine to wait for the processing of inputted signal and confirm the scope of motion blur reduction (MBR).

Figure 6A:
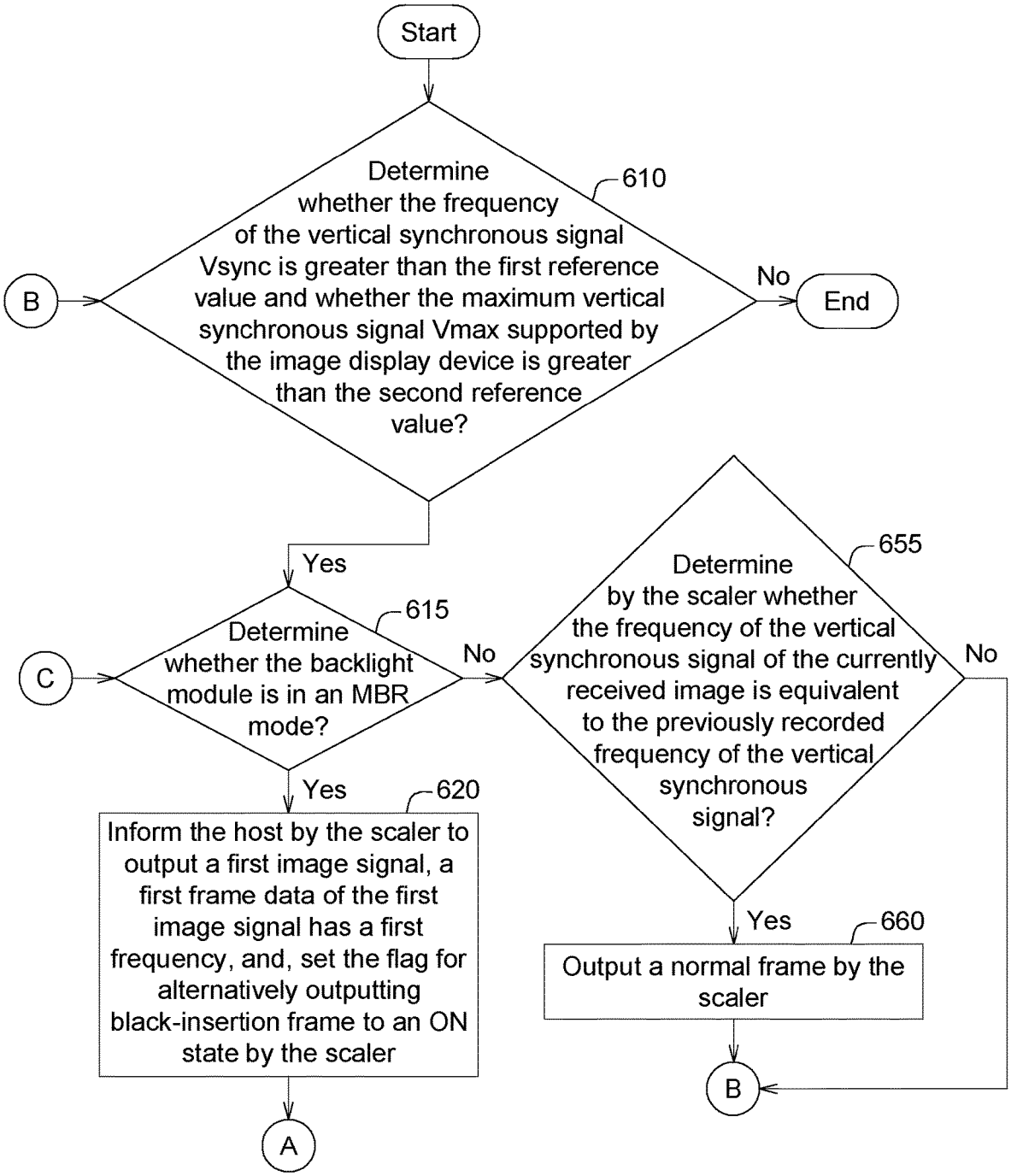
FIG. 6A and FIG. 6B are flowcharts of a control method for an image display device according to another embodiment of the present invention.
Figure 6B:
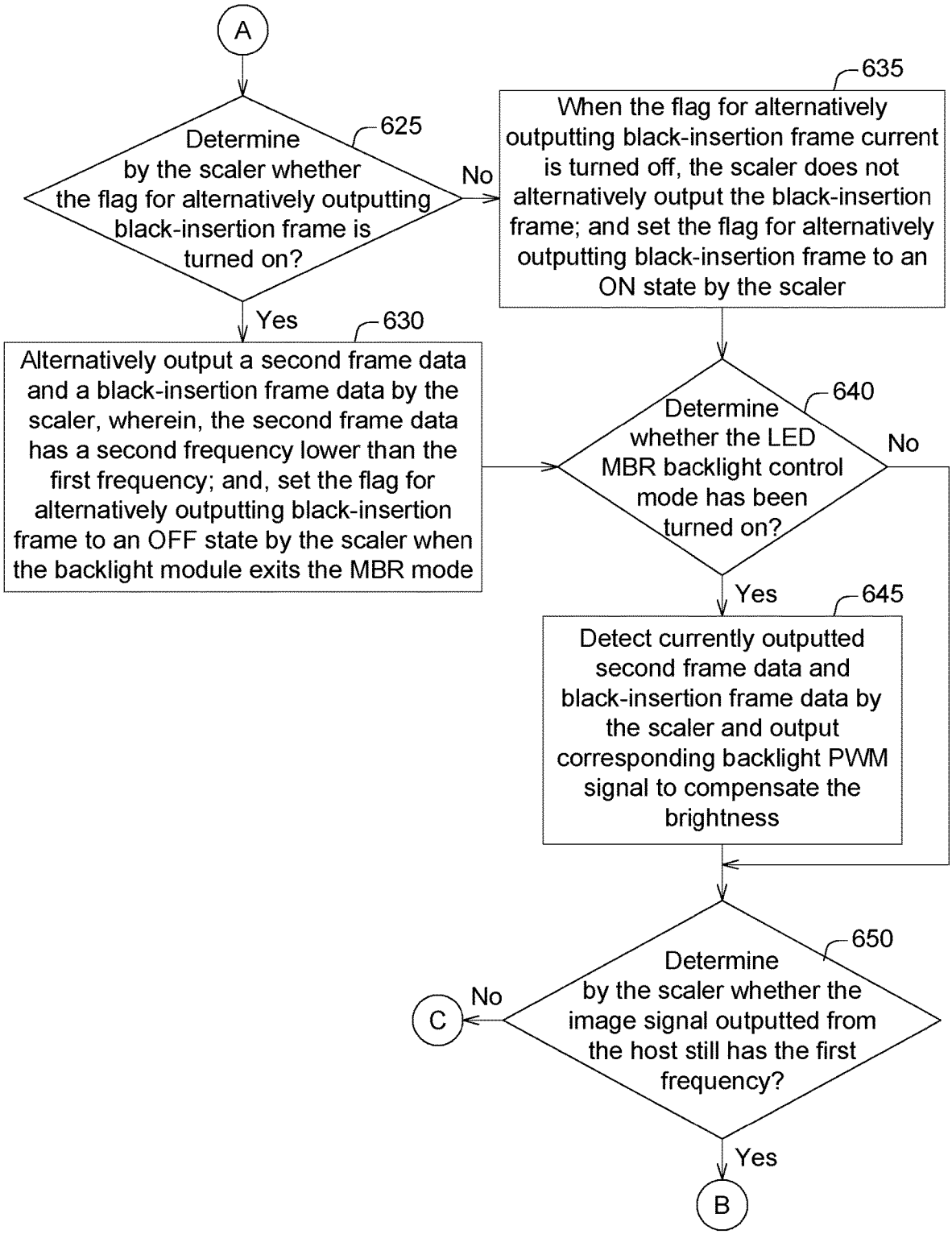

FIG. 6A and FIG. 6B are flowcharts of a control method for an image display device according to another embodiment of the present invention. In step 610, whether the frequency of the vertical synchronous signal Vsync of the received image data VD is greater than the first reference value and whether the maximum vertical synchronous signal Vmax supported by the image display device 100 is greater than the second reference value are determined by the scaler 110. In an illustrative rather than a restrictive sense, the first reference value and the second reference value are exemplified by 120 Hz and 240 Hz respectively. If the determination result in step 610 is positive, then the method proceeds to step 615; If the determination result in step 610 is negative, the method terminates.

In step 615, whether the backlight module 230 is in an MBR mode is determined by the scaler 110. If the determination result in step 615 is positive, then the method proceeds to step 620. If the determination result in step 615 is negative, then the method proceeds to step 655.

In step 620, if the backlight module 230 is in an MBR mode, the host 150 is informed by the scaler 110 to output a first image signal, wherein a first frame data of the first image signal has a first frequency (in an illustrative rather than a restrictive sense 240 Hz), and, the flag for alternatively outputting black-insertion frame is set to an ON state by the scaler 110 (in an illustrative rather than a restrictive sense, logic 1 represents that the function for alternatively outputting black-insertion frame is turned on).

In step 625, whether the flag for alternatively outputting black-insertion frame is turned on is determined by the scaler 110. If the determination result in step 625 is positive, then the method proceeds to step 630. If the determination result in step 625 is negative, then the method proceeds to step 635.

In step 630, when the flag for alternatively outputting black-insertion frame is turned on, the black-insertion frame is alternatively outputted by the scaler 110. For example, the scaler 110 alternatively outputs a second frame data and a black-insertion frame data, wherein, the second frame data has a second frequency lower than the first frequency; and, when the backlight module exits the MBR mode, the scaler 110 sets the flag for alternatively outputting black-insertion frame to an OFF state (in an illustrative rather than a restrictive sense, logic 0 represents that the function for alternatively outputting the black-insertion frame is turned off).

In an example of the present invention, in step 630, the implementations for inserting black frames into the first image signal outputted from the scaler 110 by the host 150 are exemplified below. The frequency of the vertical synchronous signal of the first image signal outputted from the host 150 is N Hz (N is a positive integer). Then, in a possible example, the scaler 110 alternatively outputs a second frame data (has (N/2) Hz) and a black-insertion frame data (has (N/2) Hz) to achieve 1/2 frequency division. Or, in another possible example, the scaler 110 alternatively outputs a second frame data (has (N/3) Hz) and a black-insertion frame data (has (N*2/3) Hz) to achieve 1/3 frequency division.

In step 635, when the flag for alternatively outputting black-insertion frame current is turned off, the scaler 110 does not alternatively output the black-insertion frame, for example, the scaler 110 continues to output the first image signal outputted from the host 150 (that is, does not insert black frame); and the scaler 110 sets the flag for alternatively outputting black-insertion frame to an ON state.

In step 640, whether the LED MBR backlight control mode has been turned on is determined. If the determination result in step 640 is positive, then the method proceeds to step 645. If the determination result in step 640 is negative, then the method proceeds to step 650.

In step 645, currently outputted second frame data and black-insertion frame data are detected by the scaler 110, and corresponding backlight PWM signal is outputted to compensate the brightness.

In step 650, whether the image signal outputted from the host 150 still has the first frequency (such as 240 Hz) is determined by the scaler 110. If the determination result in step 650 is positive, then the method proceeds to step 610. If the determination result in step 650 is negative, then the method proceeds to step 615 (that is, when the frequency of the image signal outputted from the host 150 is erroneous, the scaler 110 informs the host 150 to output an image signal having the first frequency again).

In step 655, if the backlight module is not in the MBR mode, whether the frequency of the vertical synchronous signal of the currently received image is equivalent to the previously recorded frequency of the vertical synchronous signal is determined by the scaler 110 through comparison. If the determination result in step 655 is positive (frequency is different), then in step 660, a normal frame is outputted by the scaler 110 (the normal frame has the previously recorded frequency of the vertical synchronous signal). If the determination result in step 655 is negative (frequency is the same), then the method proceeds to step 610.

Figure 7:
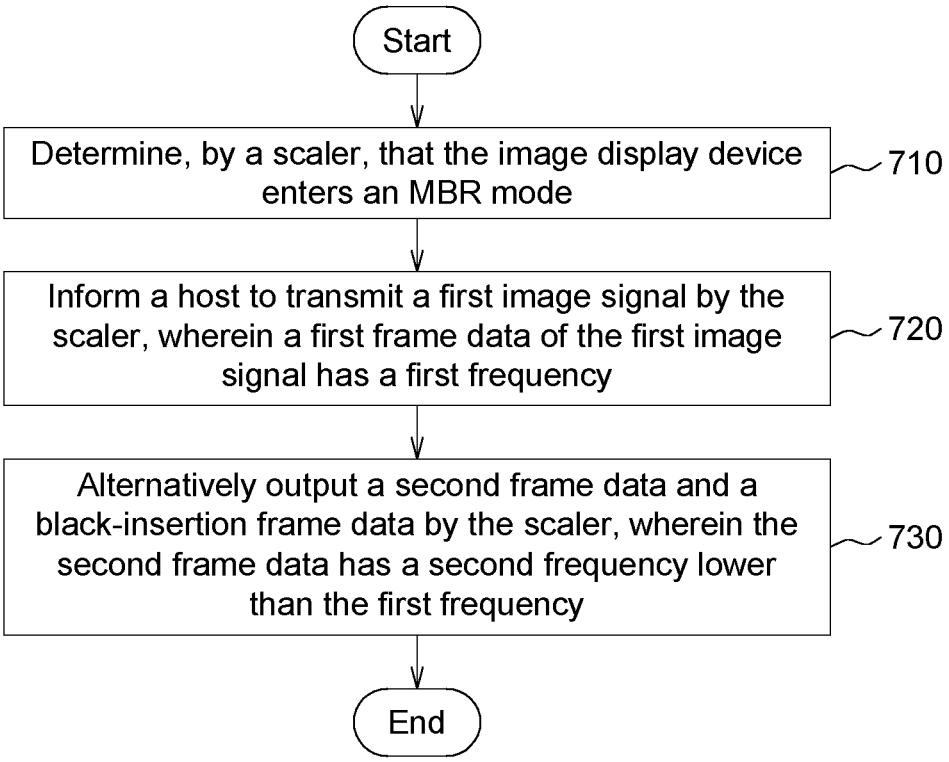
FIG. 7 is a control method for an image display device according to an embodiment of the present invention.

FIG. 7 is a control method for an image display device according to an embodiment of the present invention. The control method includes the following steps: the image display device enters an MBR mode is determined by a scaler (710); a host is informed to transmit a first image signal by the scaler, wherein a first frame data of the first image signal has a first frequency (720); and a second frame data and a black-insertion frame data are alternatively outputted by the scaler, wherein the second frame data has a second frequency lower than the first frequency (730). Details of steps 710-730 can be obtained with reference to FIG. 6, and therefore are omitted here.

In another embodiment of the present invention, during the switching of the MPRT function, the scaler outputs alternated black-insertion frames, so that LCD black-insertion can be implemented to directly reduce motion blur and eliminate fluorescent red residuals without changing the backlight mechanism.

Thus, the image display device and the control method disclosed in above embodiments of the present invention can be used to personal computers, notebook computers, tablet devices, TVs, projectors . . . and other related fields of electronic products.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A control method for an image display device, comprising:

receiving a first image signal from a host and displaying a frame, wherein a first frame data of the first image signal has a first frequency;

determining that the image display device enters a motion blur reduction (MBR) mode and writing a double frequency of a vertical synchronous signal into a storage unit; and informing the host to read the double frequency of the vertical synchronous signal from the storage unit, and alternatively output a second frame data and a black-insertion frame data from the host, wherein the second frame data has a second frequency higher than the first frequency.

2. The control method for the image display device according to claim 1, wherein, when it is determined that the image display device has not entered the MBR mode, a frequency of the vertical synchronous signal is written into the storage unit; and informing the host to output the first frame data according to the frequency of the vertical synchronous signal.

3. The control method for the image display device according to claim 1, further comprising:

when it is determined that an LED MBR backlight control mode is turned on, controlling the backlight module by a pulse width modulation (PWM) mode; and when the LED MBR backlight control mode is turned off, turning off the PWM mode and enabling the backlight module to continue outputting a backlight.

4. The control method for the image display device according to claim 3, wherein, when the backlight module is controlled using the PWM mode:

detecting a current frame state, and controlling the backlight module using the PWM mode in synchronization with the normal frame.

5. The control method for the image display device according to claim 3, wherein, when the backlight module is controlled using the PWM mode, controlling the backlight module using the PWM mode in synchronization with the vertical synchronous signal.

6. The control method for the image display device according to claim 3, wherein, when the backlight module is controlled using the PWM mode:

detecting the current frame state, and independently controlling the backlight module using the PWM mode in synchronization with the normal frame.

7. The control method for the image display device according to claim 1, further comprising:

determining, by the host, whether an instruction to enter the MBR mode or an instruction to exit the MBR mode has been received;

when the host receives the instruction to enter the MBR mode, setting the vertical synchronous signal to a boosted frequency or a maximum frequency by the host; and alternatively outputting the second frame data and the black-insertion frame by the host at the boosted frequency or the maximum frequency.

8. The control method for the image display device according to claim 7, further comprising:

when the host receives the instruction to exit the MBR mode, recovering the vertical synchronous signal by the host; and outputting the first frame data by the host.

9. An image display device, comprising:

a scaler;

a backlight module coupled to the scaler; and a storage unit coupled to the scaler, wherein, the image display device receives a first image signal from a host and displays a frame, wherein a first frame data of the first image signal has a first frequency;

when the scaler determines that the image display device enters a motion blur reduction (MBR) mode, the scaler writes a double frequency of a vertical synchronous signal into a storage unit; and the scaler informs the host to read the double frequency of the vertical synchronous signal from the storage unit, and, the image display device receives a second frame data and a black-insertion frame data alternatively outputted from the host, wherein the second frame data has a second frequency higher than the first frequency.

10. The image display device according to claim 9, wherein, when the scaler determines that the image display device has not entered the MBR mode, the scaler writes the frequency of the vertical synchronous signal into the storage unit; and the scaler informs the host to output the first frame data according to the frequency of the vertical synchronous signal.

11. The image display device according to claim 9, further comprising:

when it is determined that an LED MBR backlight control mode is turned on, the scaler controls the backlight module by a pulse width modulation (PWM) mode; and when the LED MBR backlight control mode is turned off, the PWM mode is turned off, and the backlight module is enabled to continue outputting a backlight.

12. The image display device according to claim 11, wherein, when the scaler controls the backlight module using the PWM mode:

the scaler detects a current frame state and controls the backlight module using the PWM mode in synchronization with the normal frame.

13. The image display device according to claim 11, wherein, when the scaler controls the backlight module using the PWM mode:

the scaler controls the backlight module using the PWM mode in synchronization with the vertical synchronous signal.

14. The image display device according to claim 11, wherein, when the scaler controls the backlight module using the PWM mode:

the scaler detects the current frame state and independently controls the backlight module using the PWM mode in synchronization with the normal frame.

15. A control method for an image display device, comprising:

determining, by a scaler, that the image display device enters an MBR mode;

informing a host to transmit a first image signal by the scaler, wherein a first frame data of the first image signal has a first frequency; and alternatively outputting a second frame data and a black-insertion frame data by the scaler, wherein the second frame data has a second frequency lower than the first frequency.

16. The control method for the image display device according to claim 15, wherein, when the scaler determines that the image display device enters the MBR mode, setting a flag for alternatively outputting black-insertion frame to an ON state by the scaler.

17. The control method for the image display device according to claim 15, wherein, determining, by the scaler, whether the flag for alternatively outputting black-insertion frame is turned on;

when the flag for alternatively outputting black-insertion frame is turned on, alternatively outputting the second frame data and the black-insertion frame data by the scaler; and, when the image display device leaves the MBR mode, setting the flag for alternatively outputting black-insertion frame to an OFF state by the scaler; and when the flag for alternatively outputting black-insertion frame is turned off, prohibiting alternatively outputting the black-insertion frame by the scaler; and setting the flag for alternatively outputting black-insertion frame to an ON state by the scaler.

18. An image display device, comprising:

a scaler;

a backlight module coupled to the scaler; and a storage unit coupled to the scaler, wherein, the scaler determines that the image display device enters an MBR mode;

the scaler informs a host to transmit a first image signal, wherein a first frame data of the first image signal has a first frequency; and the scaler alternatively outputs a second frame data and a black-insertion frame data, wherein the second frame data has a second frequency lower than the first frequency.

19. The image display device according to claim 18, wherein, when the scaler determines that the image display device enters the MBR mode, the scaler sets a flag for alternatively outputting black-insertion frame to an ON state.

20. The image display device according to claim 18, wherein, the scaler further determines whether the flag for alternatively outputting black-insertion frame is turned on;

when the flag for alternatively outputting black-insertion frame is turned on, the scaler alternatively outputs the second frame data and the black-insertion frame data; and, when the image display device leaves the MBR mode, the scaler sets the flag for alternatively outputting black-insertion frame to an OFF state; and when the flag for alternatively outputting black-insertion frame is turned off, the scaler does not alternatively output the black-insertion frame; and the scaler sets the flag for alternatively outputting black-insertion frame to an ON state.

* * * * *